US007908963B2

(12) United States Patent
Frenken

(10) Patent No.: US 7,908,963 B2
(45) Date of Patent: Mar. 22, 2011

(54) METHOD OF OPERATING A HYDRAULIC PRESSING UNIT, AND HYDRAULIC PRESSING UNIT HAVING A HYDRAULIC PUMP

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 12/302,549

(22) PCT Filed: May 29, 2007

(86) PCT No.: PCT/EP2007/055156

§ 371 (c)(1),
(2), (4) Date: Jan. 5, 2009

(87) PCT Pub. No.: WO2007/141156

PCT Pub. Date: Dec. 13, 2007

(65) Prior Publication Data

US 2009/0133591 A1 May 28, 2009

(30) Foreign Application Priority Data

Jun. 8, 2006 (DE) ..... 10 2006 026 552

(51) Int. Cl.
*B30B 1/23* (2006.01)

(52) U.S. Cl. ..... 100/269.01; 72/453.01

(58) Field of Classification Search ..... 100/269.01, 100/279, 269.14, 269.15, 269.16, 269.18, 100/269.19; 72/453.01, 453.14, 453.15, 453.16, 453.17, 453.18, 453.19
See application file for complete search history.

(56) References Cited

U.S. PATENT DOCUMENTS

| | | | | |
|---|---|---|---|---|
| 3,884,262 | A * | 5/1975 | Assembergs | 137/489 |
| 3,973,595 | A * | 8/1976 | Schmoll | 137/637.1 |
| 4,433,612 | A * | 2/1984 | Spielvogel et al. | 91/514 |
| 5,315,744 | A * | 5/1994 | Denham et al. | 29/243.53 |
| 5,778,516 | A * | 7/1998 | Dear et al. | 29/707 |
| 6,718,870 | B1 | 4/2004 | Frenken | |
| 6,769,356 | B2 | 8/2004 | Frenken | |
| 7,331,205 | B2 * | 2/2008 | Chitty et al. | 72/21.1 |

FOREIGN PATENT DOCUMENTS

| | | |
|---|---|---|
| DE | 198 25 160 | 4/1999 |
| DE | 198 14 202 | 10/1999 |

* cited by examiner

*Primary Examiner* — Jimmy T Nguyen
(74) *Attorney, Agent, or Firm* — Clark Hill PLC

(57) ABSTRACT

A hydraulic pressing unit includes a hydraulic pump, supply and hydraulic chambers, moving and stationary parts, a restoring spring, and a return valve provided within or attached to a housing. The moving part is displaced from a starting position into a pressing position as a result of filling the hydraulic chamber with a hydraulic medium from the supply chamber by using the hydraulic pump. The return valve is automatically displaced into an open position as a result of a hydraulic pressure corresponding to the pressing position, and the restoring spring moves the moving part. A piston acts on the flow of the hydraulic medium and lowers the pressure such that the return valve is displaced into the closed position.

22 Claims, 6 Drawing Sheets

METHOD OF OPERATING A HYDRAULIC PRESSING UNIT, AND HYDRAULIC PRESSING UNIT HAVING A HYDRAULIC PUMP

This patent application is a the National Stage filing of IB application number PCT/EP2007/055156, filed May 29, 2007, published as WO 07/141,156 on Dec. 13, 2007. IB application number PCT/EP2007/055156 claims priority from German Patent Application No. 10 2006 026 552.1 dated Jun. 8, 2006.

FIELD OF THE INVENTION

The invention relates in first instance to a method of operating a hydraulic pressing unit, in particular a manual pressing unit, the pressing unit having a hydraulic pump, a moving part, a stationary part and a return valve, furthermore the moving part being displaced into a pressing position by the buildup of a hydraulic pressure obtained by using the hydraulic pump for filling a hydraulic chamber with hydraulic medium from a supply chamber, furthermore the moving part being designed to move back automatically from the pressing position into an end position under the action of a restoring spring and the return valve being designed to close only after the pressure drops below a certain pressure acting on the return valve due to the hydraulic medium running back.

BACKGROUND OF THE INVENTION

Hydraulic pressing units and methods of operating the same are known. In this respect, reference is made for example to DE 198 25 160 A1. Described there is a hand-operated pressing unit which is provided with a return valve that is triggered when a predetermined pressure on the moving part is reached or exceeded. After opening of the return valve, the moving part returns under spring biasing, with the hydraulic medium that acts upon the moving part being forced back into the supply chamber via the return valve. This achieves a pressure acting on the return valve that only corresponds to a fraction of the triggering pressure of the return valve but keeps the return valve in the open position. If the pressure drops below this predetermined return pressure, the return valve closes, after which the pressing unit is ready again for the next pressing operation.

In the case of the known unit, a method of the generic type has already been realized to great advantage and has found widespread use. It is usually also the case that the configuration is advantageous and satisfactory. However, there are situations in which early stopping of the moving part in the return direction is desired, without the displacement of the moving part into the end position being obstructed in other cases.

With regard to the prior art described above, a technical problem for the invention is seen in providing a method of operating a hydraulic pressing unit that makes it possible for the moving part to be stopped in a position according to choice.

SUMMARY OF THE INVENTION

This problem is solved in the following manner. In order to have an effect on the hydraulic medium flowing upstream of the return valve when said return valve is open, means are provided which counteract the flow of the hydraulic medium in such a way that a pressure drop occurring leads to the displacement of the return valve into the closed position. As a result of this method according to the invention, stopping of the moving part in an intermediate position is also made possible. In the course of the forward displacement, i.e. in the course of a pressing operation, stopping of the moving part can also be achieved in a known manner by stopping the hydraulic pump. In the course of the return of the moving part, which is achieved under spring biasing by a return valve that is self-holding as known from the aforementioned DE 198 25 160 A1, stopping of the moving part is brought about by acting on the return flow. Provided for this purpose are means which act on the return flow of the hydraulic medium upstream of the return valve, i.e. between the moving part and the return valve, in such a way that there is a pressure drop, optionally only a brief pressure drop, which is sufficient to cancel out the preferably provided self-holding of the return valve in the open position. The action of the means causes the holding pressure of the return valve to be lowered, after which the return valve falls into the closed position. Accordingly, hydraulic medium no longer flows into the supply chamber. The remaining cushion of hydraulic medium upstream of the moving part has the effect of stopping the same. The means that act on the return flow of the hydraulic medium to stop the moving part may be purely mechanical means that are deliberately actuated by the user as and when required. So, in the simplest case, the return line between the moving part and the return valve may be closed by a slide valve, whereby the desired pressure drop at the return valve is achieved. This slide-valve closure may for example also take place electromechanically, for example initiated by a signal for starting a new pressing operation, i.e. a signal for starting the hydraulic pump. A separate button or the like for stopping the return movement of the moving part may also be provided on the hydraulic pressing unit, by means of which button it is possible to bring about a mechanical or electrical action on the means controlling the flow. The effect on the return flow preferably takes place only briefly. The immediately occurring pressure drop leads to almost abrupt closing of the valve, after which further action by the means is not necessary.

So, it is provided in an advantageous development of the subject matter of the invention that the flow is acted on by briefly decoupling a partial amount of the hydraulic medium, which brief decoupling leads to a pressure drop in the return line. The brief decoupling of a partial amount may be achieved, for example, by a briefly released line branch, in which furthermore for example a piston-like means is disposed. As and when required, this sucks a partial amount out of the actual return path, which leads to the desired pressure drop.

A configuration in which the decoupling is achieved by displacing a control piston disposed in the flow path counter to the direction of flow is preferred. This control piston operating counter to the direction of flow brings about a brief intake of the returning hydraulic medium, thereby entraining hydraulic medium, though only a small amount. Here too, this effect that is brought about on the return flow brings about a pressure drop, which results in the closing of the return valve.

The pressure drop to achieve the closed position of the return valve is of the order of approximately 0.5 to 1 bar. The self-holding of the return valve in the course of the return of the moving part is achieved at a pressure of approximately 0.5 to 2.5 bar, more particularly at 1.5 bar, while the first opening of the return valve to complete the pressing operation takes place at a pressure of approximately 400 to 800 bar, more particularly at 500 or 700 bar, preferably at 600 bar, after which a pressure of approximately 1.5 to 5 bar, preferably 2.5 bar, is present by way of a restoring spring, which acts on the moving part in the return directly in the region of the moving part. The pressure difference of at least 1 bar between the region acted upon by the returning moving part and the region of the return valve is primarily used up as a throttling loss during the flow through small bores of the sealing seat interacting in the closed position with smaller partial piston areas.

The control piston is preferably held in a non-actuated outflow position by the return flow alone, the control piston in this outflow position leaving a flow passage for the returning hydraulic medium. This flow passage is furthermore made of such a size that it does not produce any pressure losses with an adverse effect on the self-holding of the return valve. In the actuated pumping position of the pressing unit, on the other hand, the control piston leads to a shutting-off of the flow, i.e. of the return flow, accordingly initiation of a pressing operation at the same time brings about the displacement of the control piston into a shut-off position. This shutting-off alone leads to a pressure drop at the return valve, as a result of which the latter closes. The displacement of the control piston counter to the flow direction of the returning hydraulic medium as a result of the pressing unit being put into operation also brings about an intake of a partial amount of the hydraulic medium, which further helps to bring about the desired pressure drop for closing the return valve.

When a renewed pressing operation is initiated, the control piston may, for example, be brought into the pumping position by mechanical means. However, a method in which the control piston is moved from the outflow position, in which it leaves a flow passage for the returning hydraulic medium, into the pumping position by pumping hydraulic medium out of the supply reservoir into the hydraulic chamber is preferred. Accordingly, the control piston is disposed with its piston area in the feed path of the hydraulic medium in such a way that, by putting the hydraulic pump into operation, the delivered hydraulic medium first brings about a displacement of the control piston from the outflow position into the pumping position by means of the control piston area, while producing a pressure drop for closing the return valve.

In the return direction of the moving part, the control piston is disposed beyond the end position of the moving part. Accordingly, the moving part does not act directly on the control piston, but rather by way of the hydraulic medium forced back by means of the spring-loaded moving part.

The invention also relates to a hydraulic pressing unit having a hydraulic pump, a moving part, a stationary part and a return valve, the moving part being displaced from a starting position into a pressing position as a result of filling a hydraulic chamber with hydraulic medium from a supply reservoir by means of the hydraulic pump, the return valve being automatically displaced into an open position in dependence on a hydraulic pressure corresponding to the pressing position and the moving part returning under the action of a restoring spring.

A pressing unit of the type in question is known from DE 198 25 160 A1, cited at the beginning.

It is an object of the invention to improve a hydraulic pressing unit of the type in question, in particular technically in terms of handling.

This object is achieved first and foremost by means provided which act on the flow of the hydraulic medium with the effect of a lowering of the pressure in such a way that the return valve is displaced into the closed position. This configuration creates a pressing unit of the type in question which can be stopped in the chosen position of the moving part. So, stopping of the moving part in the forward direction of displacement, i.e. in the pressing direction, can be achieved at any time in the customary manner by switching off the hydraulic pump. The return movement after exceeding the pressure threshold value reached in the course of the pressing operation, or else initiated by manual intervention in the course of the forward displacement of the moving part, can also be stopped at any time as a result of the present invention, for which purpose means are provided which reduce the pressure required for the self-holding of the return valve in the open position in such a way that a drop of the return valve is achieved. The means intervene here in the return flow of the hydraulic medium between the moving part and the return valve. The lowering of the pressure achieved by the means is in this case of the order of 0.5 to 5 bar, preferably 1 to 1.5 bar, the pressure acting on the return valve for the self-holding of the valve in the open position also lying between 0.5 and 5 bar, preferably at 1.5 bar.

So, it is provided in an advantageous development of the subject matter of the invention that the hydraulic chamber has a first sub-chamber, in which the moving part is displaced, and a second sub-chamber, which is formed as a line portion in which the hydraulic medium for filling or emptying the first sub-chamber flows, and that the means are disposed in the second sub-chamber. In a preferred configuration, the moving part is formed in the manner of a piston for acting directly upon a piston or a piston rod associated with the tool that can be associated with the pressing unit. The first sub-chamber, enclosing this moving part in particular in a cylindrical manner, is substantially separate from the second sub-chamber, further upstream in the direction of inflow, a flow connection between the sub-chambers initially being achieved by an inflow channel. A return channel, through which the hydraulic medium flows after triggering of the return valve and corresponding displacement of the same into the open position as a result of the spring-loaded return displacement of the moving part, is formed so as to connect the two sub-chambers, optionally in a switchable manner.

The means may be formed for the brief decoupling of a partial amount of the hydraulic medium. So, in the simplest way, a lowering of the pressure is achieved by a slide-valve-like member, which is pushed into the flow path between the moving part and the return valve, interrupting the flow. Moreover, the brief effect of a reduced pressure on the flow path may lead to corresponding decoupling of a partial amount of the return flow, which accordingly results in a lowering of the pressure at the return valve. In a configuration given by way of example, a cross-channel opening out in the return flow channel may be provided here, in which cross-channel a piston-like means acts with a sucking effect on the returning hydraulic medium to initiate stop of the return.

In a further detail, it may be provided that the means are formed in the line portion for switching over between a first line path and a second line path, the decoupling taking place in the course of the switching over. Means in the line portion preferably switch between the line path for the incoming flow to the moving part in the course of a pressing operation and the line path for the return flow of the hydraulic medium in the course of the return displacement of the moving part. The decoupling of a partial amount of the hydraulic medium in the course of the return is preferably derived from the movement of the means resulting from the switching over of the means between the first line path and the second line path. Correspondingly, the movement of the means and the decoupling for lowering the pressure upstream of the return valve are coupled.

In more concrete terms, the means comprise a control piston that can be displaced in the second sub-chamber. This control piston can be displaced in the second sub-chamber along a piston body axis, displaceably between two end positions, one corresponding to the feed position of the hydraulic medium for acting upon the moving part and the other corresponding to the return position of the hydraulic medium when the return valve is open. The control piston has an effective piston area and a piston shaft. The latter is for releasing or closing a hydraulic line connected downstream of the hydraulic pump, in particular the feed flow line connecting the first sub-chamber to the second sub-chamber. The control piston is in this case preferably positioned and formed in such a way that, in the customary operating position, in which hydraulic medium is pumped into the hydraulic chamber by means of the hydraulic pump, it remains in a displaced-forward position, in which the aforementioned hydraulic line is enabled. Furthermore, the piston head is formed for releasing or closing an outflow line leading to the return valve in such a way that, in the displaced-forward pumping position, in which the hydraulic line between the first sub-chamber and the second sub-chamber is enabled, the outflow line leading to the return valve is blocked by the piston head. In the return position, i.e. after the pressure has exceeded the maximum pressure in the hydraulic chamber—optionally manually initiated by opening of the return valve—the control piston drops into a retracted position, in which it initially closes the hydraulic feed line and at the same time opens the outflow line leading to the return valve between the hydraulic chamber and the return valve. The control piston accordingly serves analogously as a pressure-dependent two-way valve for the alternating release/closure of the feed line and the return line.

The control piston has three areas of action, which are separate from one another. These extend in a plane perpendicular to the direction of displacement of the control piston and are preferably in the form of a circular disk or ring. A first continuous area of action of the control piston is preferably associated here with the first sub-chamber, thus accordingly with the hydraulic chamber receiving the moving part. This continuous area of action is preferably in the form of a circular disk, and in addition approximately planar. A second area of action, disposed opposite the first area of action, is associated with the outflow line, and accordingly faces in the direction of the second sub-chamber. The second area of action is preferably in the form of a circular ring with an outside diameter that substantially corresponds to the outside diameter of the first, opposite area of action. In a preferred configuration, the inside diameter of the second area of action is defined by the outside diameter of the piston shaft.

A third area of action, likewise disposed opposite the first area of action, is associated with the hydraulic pump, and is accordingly acted upon in a direct manner by the hydraulic medium in the course of the forward displacement of the moving part as part of a pressing operation. This third area of action is substantially in the form of a circular disk, with an outside diameter that substantially corresponds to the outside diameter of the piston shaft.

The second and third areas of action together correspond in terms of size to the first area of action. So, in a projection onto the first area of action, the two further areas of action lie within the first area of action.

The control piston is preferably movable between an outflow position and a pumping position. So, the control piston is moved into the pumping position by subjecting the third area of action in particular to hydraulic medium. By, on the other hand, correspondingly subjecting the first area of action to hydraulic medium, the control piston is displaced in the opposite direction into the outflow position. In the outflow position, the piston head is accommodated in an annular space of enlarged diameter in comparison with the piston head, which annular space goes over into the outflow line. This annular space is not necessarily provided over the entire circumference of the piston head. It is also possible, with reference to a plan view, for segmental radial enlargements with respect to the piston head to be provided what is important is that, in the outflow position, the piston head releases paths by radial widenings, through which the hydraulic medium can flow from the first sub-chamber into the second sub-chamber, and on through the outflow line. These regions of enlarged diameter (annular space) are closed in the pumping position of the control piston.

In the outflow position, in which the control piston releases the outflow line, it acts at the same time in the manner of a slide valve to close the hydraulic line, i.e. the feed line between the first sub-chamber and the second sub-chamber, through which the hydraulic medium is pumped into the hydraulic chamber. Correspondingly, in the pumping position, in which the aforementioned hydraulic line is released, the piston acts in the manner of a slide valve to close the outflow line, the slide-valve-like closing movements of the control piston also being synchronized in such a way that simultaneous opening of the outflow line and the hydraulic line (feed line) cannot be achieved. So, the slide-valve-like closure of the hydraulic line preferably precedes the slide-valve-like opening of the outflow line.

In isolated cases, in particular in the course of switching off after pressing, there may be such a pressure difference with respect to the control piston that a considerable excess pressure occurs. To counteract this, the control piston has an integrated pressure relief valve. This is preferably formed as a line connecting the first area of action and the opposite, third area of action of the control piston, which integrated line of the control piston is opened under valve control when there is excess pressure. The pressure relief valve is formed in a structurally simple manner by a cup-spring-like valve disk secured by means of a pin. This valve disk preferably rests on sides of the first area of action, covering the associated opening edge of the pressure relief line. In a further embodiment, the pin, holding the valve disk centrally, is surrounded by the pressure relief line covered by the valve disk, which pin is moreover positioned centrally, preferably coaxially, in relation to the control piston axis. In an actual embodiment, the pin is formed as a screw, the screw head of which biases the valve disk displaceably against the peripheral edge of the associated opening of the pressure relief line.

A configuration in which the control piston, part of the outflow line and part of the hydraulic line are formed in an insert part which is fitted as a whole into a bore-like continuation of the first sub-chamber also proves to be advantageous. This creates a compact unit, which is optionally able to be removed again and which makes it possible for the hydraulic pressing unit to be fitted according to choice with means for regulating the pressure drop in the course of the return of the hydraulic medium or for pressing units to be retrofitted with such means.

DESCRIPTION OF THE DRAWINGS

The invention is explained in more detail below with reference to the accompanying drawing, which merely represents an exemplary embodiment and in which.

DETAILED DESCRIPTION OF THE ILLUSTRATED EMBODIMENT

Figure 1:
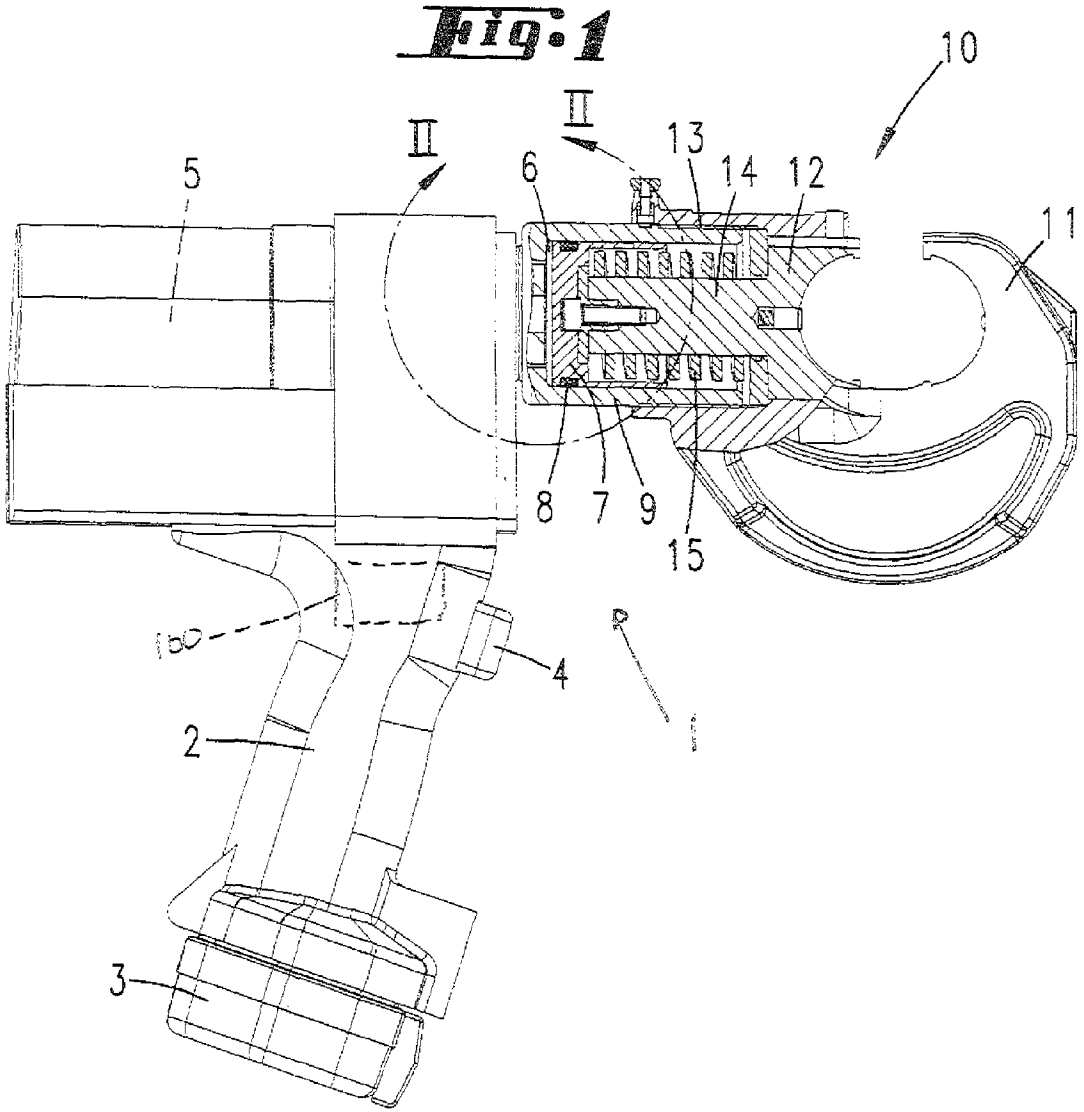
FIG. 1 shows a hydraulic pressing unit in elevation, partially in section in the region of a hydraulic chamber having a moving part, with a pressing attachment that is disposed on the pressing unit and can be operated by means of the moving part.

Shown and described, initially with reference to FIG. 1, is a hydraulic manual pressing unit 1, driven by an electric motor. Such a pressing unit is known from DE 199 44 229 A1, which is also covered by U.S. Pat. No. 6,718,870. The content of this patent application and United States patent is hereby incorporated in full in the disclosure of the present invention, including for the purpose of incorporating features of this patent application and United States patent in claims of the present invention.

Disposed in the pressing unit 1 is an electric motor (not represented). The drive of this electric motor takes place by means of a storage battery 3 integrated in a handle 2. If a finger-operated switch 4 is actuated, hydraulic medium (oil) is pumped out of a supply chamber 5 into a hydraulic chamber 6, whereby a piston-like moving part 7 displaceably accommodated in the hydraulic chamber 6 is moved in the direction of a working end position.

The moving part 7 has a radial seal 8 on its periphery. This seals off the hydraulic chamber 6, created to the rear of the moving part 7, from the hydraulic cylinder 9 guiding the moving part 7. Disposed on said hydraulic cylinder 9 is an exchangeable unit head 10, which in the embodiment represented has tool carriers 11, 12, for fitting with pressing tools that are not represented.

The exchangeable unit head 10 can be fixed on the hydraulic cylinder 9, on its outer lateral surface, by means of a threaded connection 13.

The tool carrier 11 facing away from the piston-like moving part 7 is fixed to the unit head 10, i.e. is not displaceable. On the other hand, the tool carrier 12, which is opposite this tool carrier 11 and is associated with the moving part 7, is displaceable in the direction of displacement of the moving part, for which purpose furthermore the displaceable tool carrier 12 is provided at the rear with a piston shaft 14. This is surrounded by a restoring spring 15, which further keeps the piston shaft 14 in contact with the moving part 7 on the unit side.

By pumping hydraulic medium into the hydraulic chamber 6, the moving part 7, and thereby the tool carrier 12 together with the inserted pressing tool, is displaced in the direction of the stationary tool carrier 11, and the pressing tool inserted there, which furthermore is counter to the restoring force of the spring 15.

The return displacement of the moving part 7 takes place solely as a result of the restoring force of the spring 15, which acts via the piston shaft 14, or a radial collar associated with the end of the moving part 7, on the moving part 7, the hydraulic medium also being forced by the moving part 7 out of the hydraulic chamber 6 back into the supply chamber 5.

To ensure a proper connection, and proper pressing, triggering of a return valve 16 is aimed-at, thereby ensuring that the full pressing force was operative. A return valve 16 of this kind is known from DE 198 25 160 A1, mentioned at the beginning. In this respect too, the content of this patent application is hereby incorporated in full in the disclosure of the present invention, including for the purpose of incorporating features of this patent application in claims of the present invention.

Figure 2:
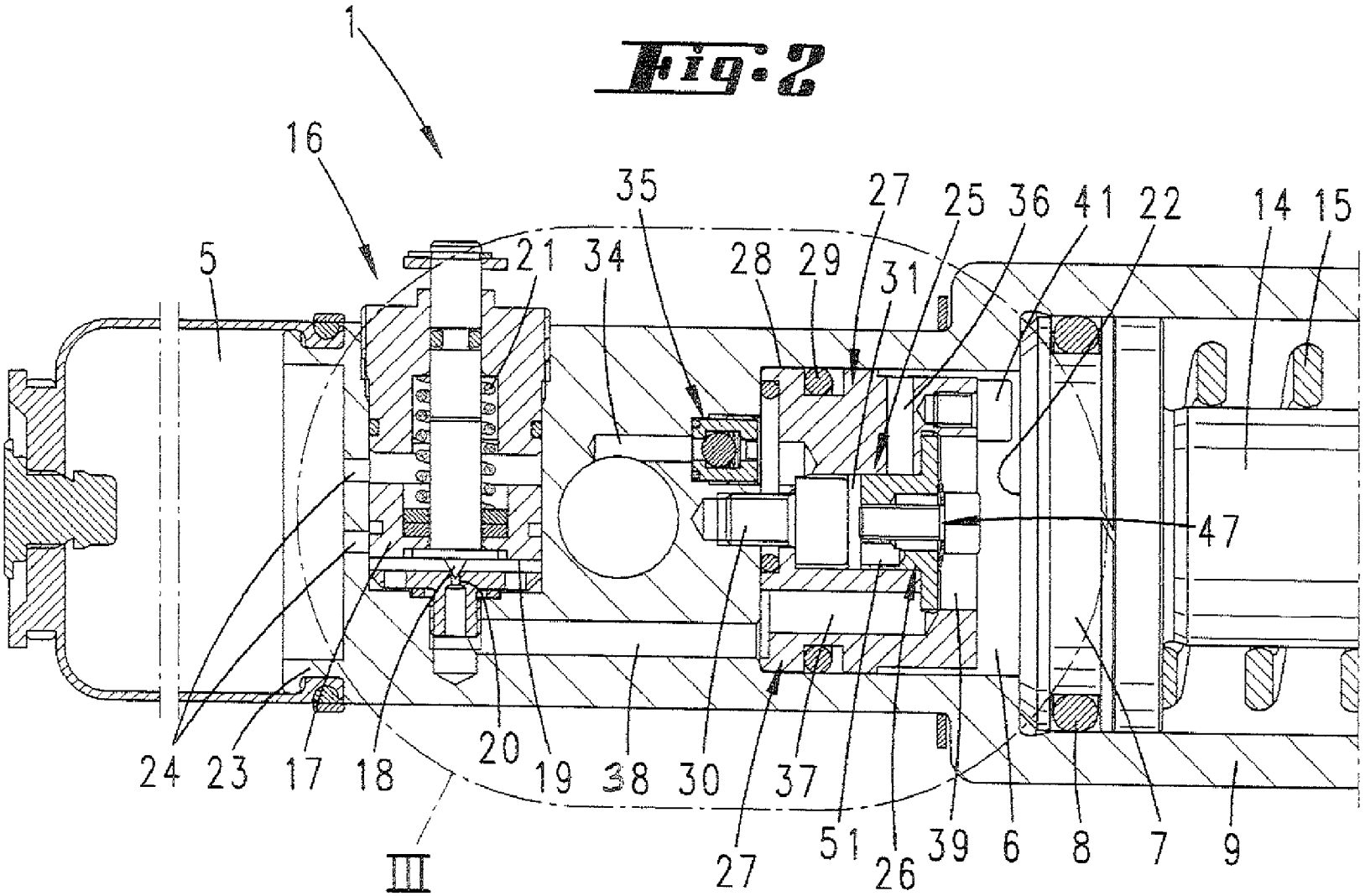
FIG. 2 shows the region II according to the representation in FIG. 1 in a longitudinal sectional representation, for a retracted basic position.

The return valve 16 substantially comprises a valve piston 17 with a pointed-conical needle tip 18, disposed centrally on the end face, for forming a partial piston area (effective seat valve area) that is much smaller than the overall piston area 19 and is defined by the diameter of a bore 20 connected to the hydraulic chamber 6. Said partial piston area is closed by the needle tip 18 in a starting closed position, as represented in FIG. 2.

Acting upon the rear of the valve piston 17 is a pressing spring 21, by which the needle tip 18 is pressed against the bore 20 with a force that plays a part in determining a maximum triggering pressure. This substantially has the result that a pressure limiting valve of the seating type is obtained.

In a preferred configuration, the return valve 16 opens under a maximum pressure acting on the hydraulic piston area 22 of the moving part 7 of 600 bar. Depending on the design, switching-off pressures of between 400 and 700 bar, such as for example 500, 550 or 650 bar, may also lead to an opening of the return valve 16. The maximum pressure is defined here by the very small partial piston area of the needle tip 18, projected onto the bore 20, or by the cross-sectional area of the bore 20 and by the pressing force of the pressing spring 21 on the valve piston 17.

When the valve piston 17 is seated, the bore 20 is open. If the pressure of the hydraulic medium exceeds the predefined maximum value, of for example 600 bar, the valve piston 17 is moved out of its seat, sealing the bore 20, counter to the force of the pressing spring 21, after which the much larger piston area 19 of the valve piston 17 abruptly comes into effect. The return displacement of the valve piston 17 causes an outflow opening 24 that is disposed in the cylinder 23 accommodating the valve piston 17 to be at least partially released, for the return flow of the hydraulic medium into the supply chamber 5.

In this position, the return valve 16 acts as a pressure limiting valve, but does so in the fashion of a sliding valve with a much lower limiting pressure, since the latter is now defined here by the much larger piston area 19 of the valve piston 17. So, in the exemplary embodiment shown, there is a diameter ratio of the smaller effective partial piston tip (needle tip 18 in bore 20) to the total piston area 19 of 1:400, which has the consequence that the limiting pressure in the open position of the return valve 16 is 400 times smaller than the triggering pressure. For example, a limiting pressure for keeping the return valve 16 open of approximately 1.5 bar is established in dependence on the piston areas in relation to one another. The restoring spring 15, acting on the moving part 7, is designed with respect to its restoring force in such a way that the pressure in the hydraulic chamber 6 when the moving part 7 moves back is always at least 2.5 bar. The pressure difference of at least 1 bar is primarily used up as a throttling loss during the flow through the small bore 20 of the return valve 16 and determines the oil throughflow, and consequently the returning speed, of the moving part 7.

After the pressure drops below the aforementioned limiting pressure, for example 1.5 bar, the return valve 16 drops again into the closed position, the relevant valve piston 17 being displaced again into the bore-closed position by means of the pressing spring 21, in which position the needle tip 18 lies in the bore 20. This dropping of the pressure below the limiting pressure occurs at the latest when the moving part 7 makes stop-limited contact with the associated cylinder bottom in the course of the return movement.

When the pressure exceeds the prescribed maximum pressure, and the accompanying automatic opening of the return valve 16 that results from this, the electric motor for pumping the hydraulic medium out of the supply chamber 5 into the hydraulic chamber 6 is at the same time switched off. After that, the pressing unit 1 is in an automatic, purely spring-loaded return.

For a renewed pressing operation, a closed return valve 16 is required. Accordingly, as explained above, it is possible to wait until the moving part 7 has been displaced under spring biasing into the end return position, as a result which the limiting pressure drops toward zero and the return valve 16 closes again.

There is, however, the need to start a renewed pressing operation from every return position of the moving part 7. Provided for this purpose are means 25 which, in the course of the return of the hydraulic medium, at least briefly lower the limiting pressure keeping the return valve 16 in the open position, such that the self-holding of the return valve 16 is brought to an end and the valve piston 17 returns for closing the bore 20 by means of the needle tip 18.

For this purpose, a control piston 26 that can be displaced in the same direction as the moving part 7 is provided. This piston is secured in an insert part 27, which, substantially in the form of a cylinder, is accommodated in a bore-like continuation 28 of the hydraulic chamber 6. The insert part 27 is provided on the outer circumferential surface with a peripheral annular seal 29, for sealing with respect to the wall of the bore-like continuation 28.

The insert part 27 is fixed by a screw 30, which engages in the bottom of the bore-like continuation 28 facing away from the moving part 7 and the screw head of which lies in a line portion 31 passing substantially centrally through the insert part 27.

The line portion 31 is accordingly aligned coaxially in relation to the body axis of the insert part 27. Furthermore, the control piston 26, which is also formed as a rotational component, lies on this body axis of the insert part 27.

The control piston 26 has a piston shaft 32 with an outside diameter that corresponds to the inside diameter of the line portion 31. The piston head is enlarged in diameter by comparison. So, the diameter of the head corresponds approximately to twice the diameter of the shaft, the axially measured thickness of the piston head 33, which protrudes in the manner of a collar, corresponding approximately to one quarter of the free length of axial extent of the piston shaft 32.

The line portion 31 is flow-connected at one end, facing away from the control piston 26, to a hydraulic inflow line 34 of the pressing unit 1, through which hydraulic medium is delivered by means of a pump 100 from the supply chamber 5, with a non-return valve 35 interposed.

Extending from the central line portion 31 is a hydraulic line 36, which is brought radially outward to the outer circumferential wall and opens out in an annular space between the insert part 27 and the bore-like continuation 28 that is created by reducing the diameter of the insert part 27. This annular space opens toward the hydraulic chamber 6 in the direction of the piston area 22 of the moving part 7.

The insert part 27 is accordingly integrated in the inflow line between the supply chamber 5 and the hydraulic chamber 6.

In the same way, the insert part 27 is also integrated between the hydraulic chamber 6 and the return valve 16, for which purpose the insert part 27 has an outflow line 37, which is disposed eccentrically in relation to the body axis of the insert part 27, runs substantially axially parallel and opens out at one end in a return line 38 in the unit housing. Said return line is connected to the return valve 16, specifically to the bore 20 on the valve seat side.

The control piston 26 is aligned in the insert part 27 coaxially in relation to the insert part axis and held displaceably in the axial direction in a stop-limited manner at the ends on both sides. The piston shaft 32 lies here in the line portion 31 of the insert part 27, while the piston head 33 of enlarged diameter lies in a bore portion 39 that is open toward the hydraulic chamber 6 and correspondingly enlarged in diameter. A rear stop face, limiting the movement of the control piston 26 in the direction of the line portion 31, is provided by the bottom 40 of the bore portion that is passed through by the line portion 31. In the opposite direction, i.e. in the direction of the hydraulic chamber 6, the head of a stop screw 41, which is screwed into the end face of the insert part 27 and the head of which protrudes radially inward beyond the associated edge of the bore portion, acts in a stop-limiting manner.

The outflow line 37 in the insert part opens out approximately with half the opening cross-section in the bore portion 39 guiding the control piston 26. Accordingly, the axis of the outflow line 37 is positioned in such a way that it runs approximately into the outer circumferential wall of the bore portion 39. The associated transitional region from the wall of the bore portion to the bottom 40 of the bore portion is enlarged in diameter with respect to the further bore portion 39 and the outside diameter of the piston head 33, so that, with the control piston 26 retracted, i.e. in the position of the same against the bottom 40 of the bore portion, a free flow-circulating region is established in the form of an annular space 50 for connecting the outflow line 37 to the hydraulic chamber 6.

Figure 3:
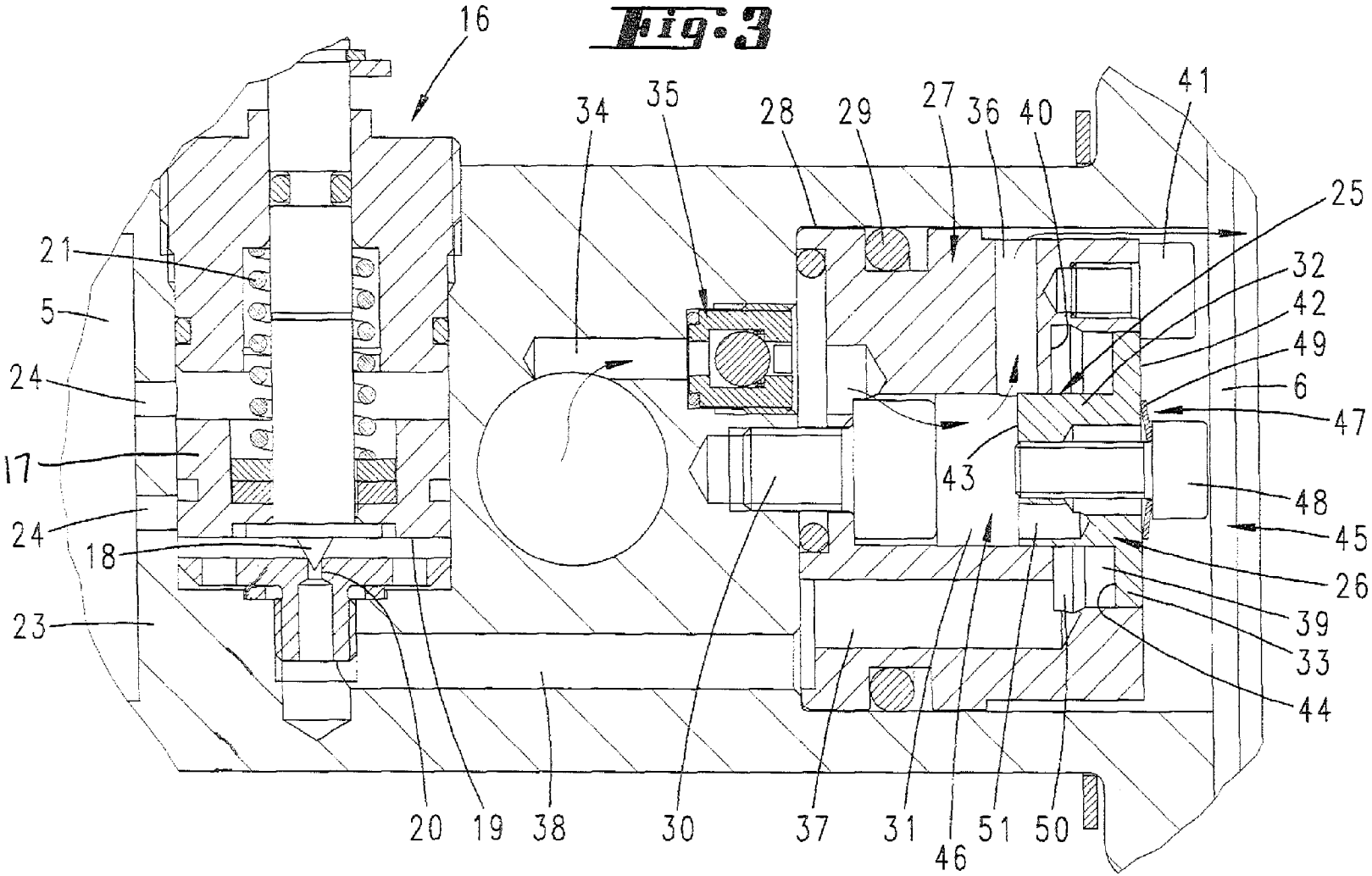
FIG. 3 shows the region III in FIG. 2 in an enlarged representation, representing the pumping position to achieve a pressing action.

The axial length of the piston shaft 32 or of the axial displacement path of the control piston 26 and the positioning of the radially aligned hydraulic line 36 are selected such that, in a pumping position according to the representation in FIG. 3 and accompanying forward displacement of the control piston 26, in which the latter comes into stop-limited contact with the screw 41, the hydraulic line 36 is in flow connection with the central line portion 31.

As a result of the chosen geometry of the control piston 26, three individual areas are established for hydraulic-medium action. So, firstly, a first area of action 42, which faces the hydraulic chamber 6 and is defined by the corresponding piston head area aligned transversely in relation to the axis. The third area of action 43 is defined by the end face of the piston shaft 32 facing away from the first area of action 42 and aligned transversely in relation to the axis. This third area of action 43 is aligned such that it is offset but parallel with the first area of action 42.

While the first and third areas of action are respectively chosen to be substantially disk-shaped, the second area of action 44 is formed as an annulus by the surface of the piston head 33 facing away from the first area of action 42, which second area of action 44 is also at the same time the mating stop face interacting with the stop face formed by the bottom 40 of the bore portion.

The second and third areas of action 44 and 43 together correspond in terms of size to the first area of action 42. Thus, in the exemplary embodiment represented, an area of action ratio of the third area of action 43 to the first area of action 42 of 1:2 to 1:4, preferably 1:3, is provided, while the ratio of the second area of action 44 to the first area of action 42 is 1:2 to 3:4, preferably 2:3.

The insert part 27, or the line paths provided in the insert part 27, are as a whole part of the hydraulic chamber 6, the control piston 26 subdividing this chamber into two sub-chambers, thus into a first sub-chamber 45, in which the moving part 7 is displaced, and a second sub-chamber 46, which forms the aforementioned line portions within the insert part 27.

The control piston 26 also has an integrated pressure relief valve 47. This is formed substantially by a cup-spring-like valve disk 49 secured by means of a screw 48 forming a pin. This valve disk 49 covers a pressure relief line 51, which passes substantially through the control piston 26 centrally in the axial direction and, facing the hydraulic chamber 6, passes centrally through the piston head 33. In the opposite direction, i.e. toward the line portion 31, a radial projection of the line is provided, to also offer centrally a thread securing portion for the screw 48, the screw head of which presses the valve disk 49 against the facing peripheral edge of the pressure relief line 51. In a position uninfluenced by excess pressure, according to the representation in FIG. 3, the valve disk 49 is in a rest position loaded by the screw 48, in which said disk closes the pressure relief line 51.

To initiate a pressing operation, when the pump 100 is switched on, hydraulic medium is forced out of the supply chamber 5 through the hydraulic inflow line 34 in the housing, running through the non-return valve 35 into the line portion 31 in the insert part, which, by way of the third area of action 44 of the control piston 26, brings about axial displacement of the control piston 26 into the displaced-forward position in the direction of the hydraulic chamber 6, the radial hydraulic line 36 being opened in the course of this displacement of the control piston 26 in the manner of a slide valve, while the piston head 33 guided in the bore portion 39 closes the outflow line 37 in the insert part in the manner of a slide valve.

The hydraulic medium is pumped via the hydraulic line 36 into the hydraulic chamber 6, which brings about an axial displacement of the moving part 7, which is displaceably held in this hydraulic chamber 6, and by this means an axial displacement of the piston shaft 14 in the unit head, to reach the pressing position.

Figure 4:
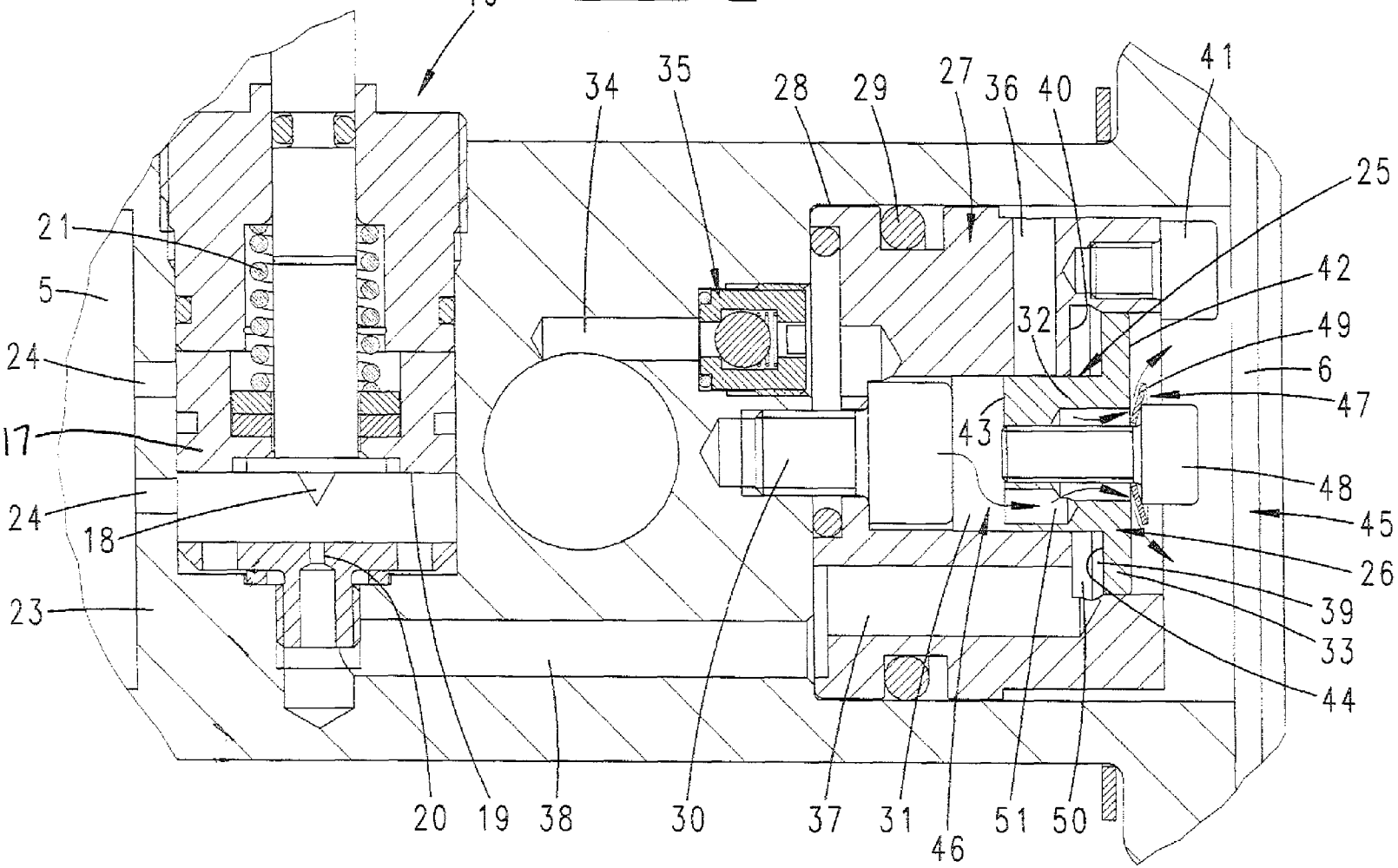
FIG. 4 shows a representation corresponding to FIG. 3, but after the pressure has exceeded a prescribed pressing pressure and subsequent automatic return of the moving part with the return valve open, representing an intermediate position in which a safety valve of a displaced-back control piston is open as a result of excess pressure.
Figure 5:
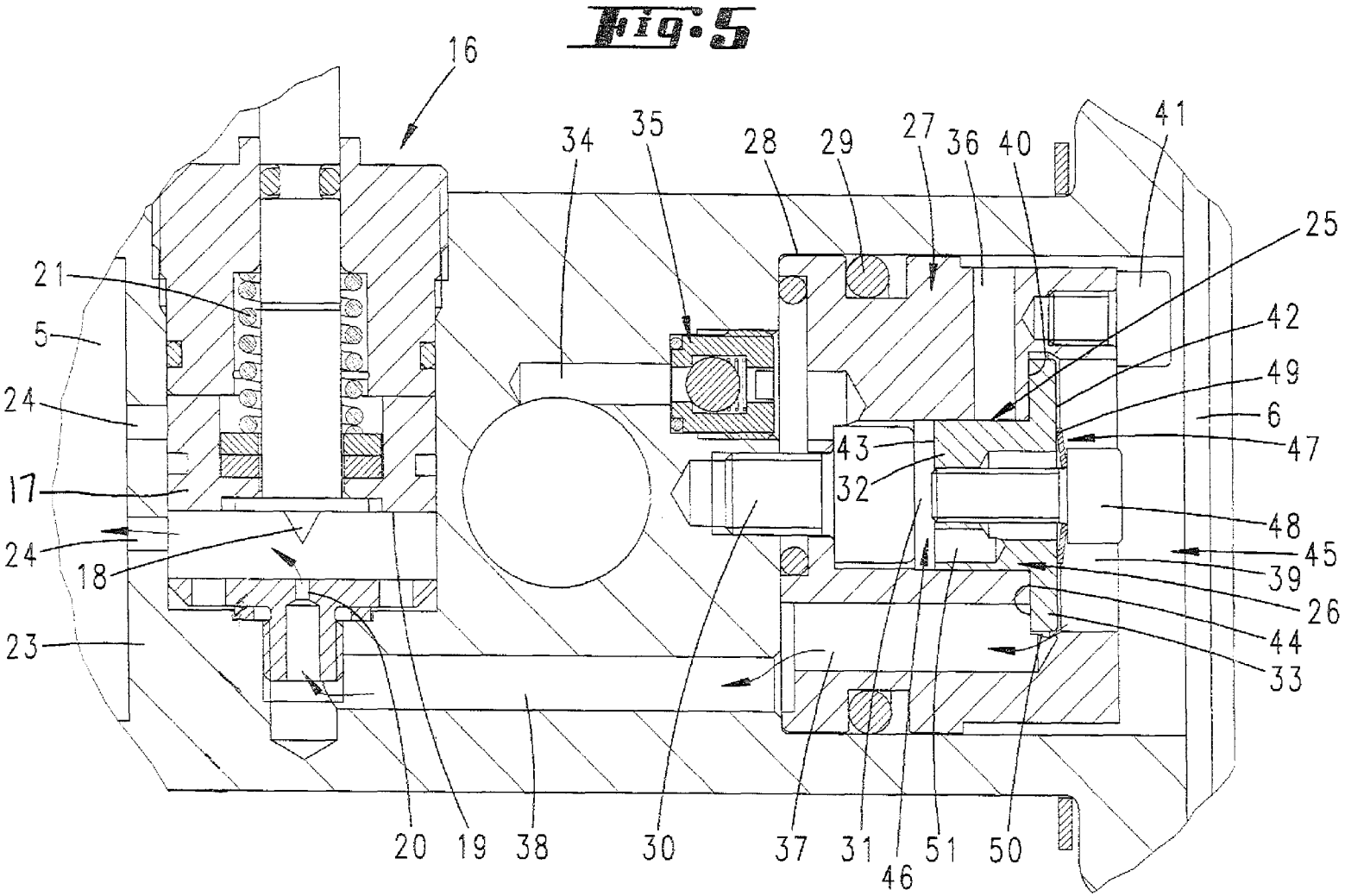
FIG. 5 shows a representation following FIG. 4, for the return position with the control piston displaced completely back.

When the maximum pressing pressure, for example 600 bar, is reached, which pressure is also built up in the line portion 31 and additionally in the outflow line 37 or return line 38 as a result of the non-pressure-resistant sealing between the piston shaft 32 and the associated wall of the line portion 31, the return valve 16 lifts off in the way described and releases the return path via the outflow opening 24. At the same time, as a result of the pressure difference that is established, the control piston 26 is displaced back in the axial direction, the remaining cushion of hydraulic medium upstream of the third area of action 43 in the line portion 31 optionally also allowing the buildup of a considerable excess pressure, which in this case is reduced by automatic, spring-like lifting of the valve disk 49 according to the representation in FIG. 4.

In the course of the return displacement of the control piston 26 into the outflow position, this piston 26 initially closes, by means of the piston shaft 32, the hydraulic line 36 extending radially from the line portion 31, to subsequently expose the radially widened annular space 50 in the stop-limited end position. Accordingly, the control piston 26 has closed the hydraulic line 36 in the manner of a slide valve and thereafter opened the outflow line 37, likewise in the manner of a slide valve.

After this, the hydraulic medium can be forced out of the hydraulic chamber 6 by means of the moving part 7 under spring loading, with the flow passing around the piston head 33.

Figure 6:
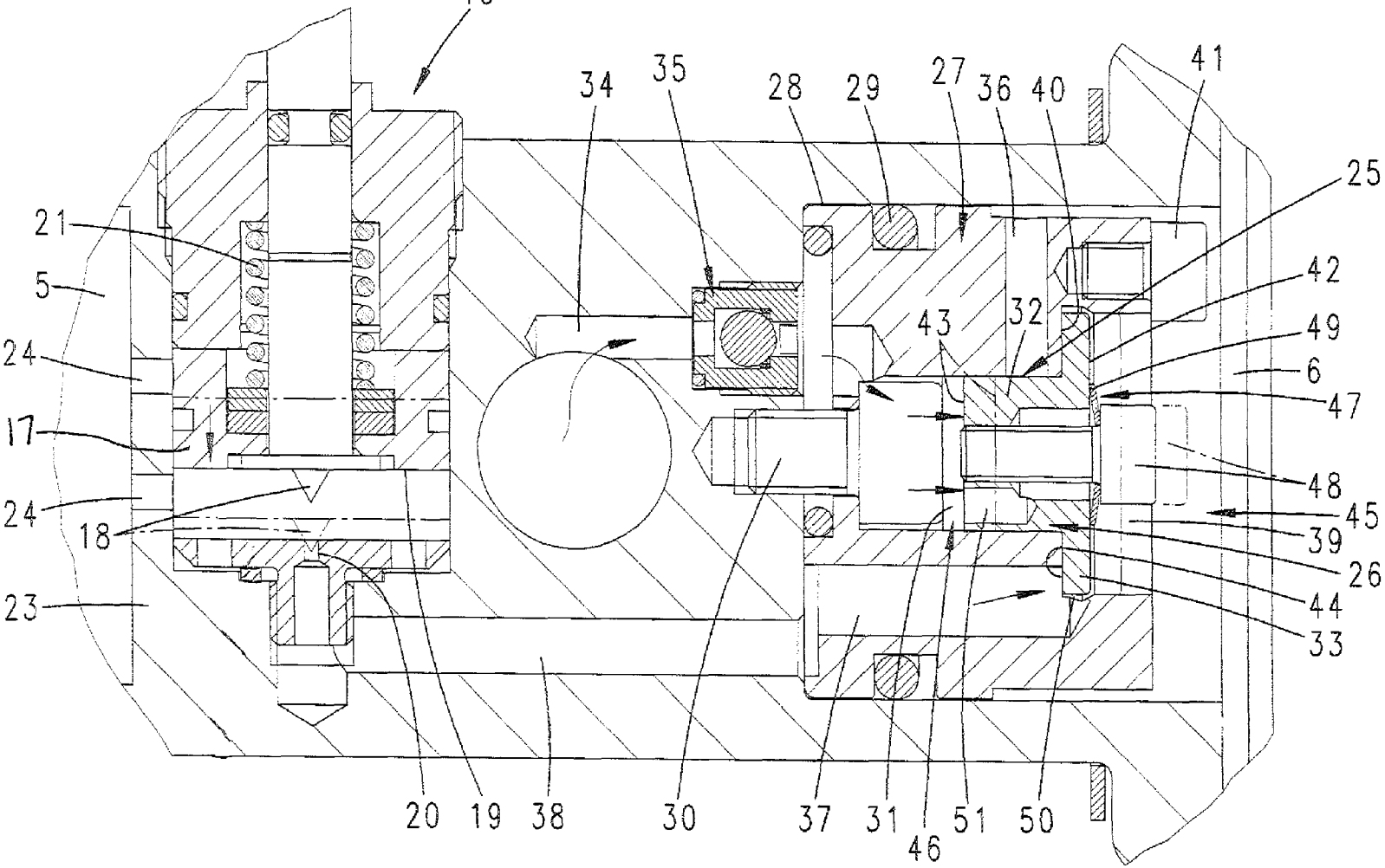
FIG. 6 shows a representation corresponding to FIG. 5, but for a situation based on an intermediate return position according to FIG. 5 or an end return position with resumed pumping-in of hydraulic medium and accompanying forward displacement of the control piston and closing of the return valve.

If there is the need to initiate a renewed pressing operation from any desired return position of the moving part 7—without waiting for the stop-limited end position of the moving part 7—all that is required is renewed actuation of the switch to activate the pump, whereupon hydraulic medium is once again pumped into the central line portion 31 in the insert part. This situation is represented in FIG. 6. Accordingly, from this situation, initially only the small-sized third area of action 43 of the piston shaft 32 is subjected to pressure, as a result of which the control piston 26 is moved again in the direction of the pumping position. The piston head 33 thereby leaves the region of the annular space of enlarged diameter of the bore portion 39; it accordingly closes the outflow line 37 in the manner of a slide valve. This is accompanied by a brief decoupling of a partial amount of the hydraulic medium located in the outflow line 37 being achieved, in particular by producing a brief suction effect in the region of the second, annular area of action 44 that faces the outflow line 37. This brings about an at least brief pressure drop in the outflow line 37, and correspondingly also in the return line 38, which pressure drop has the consequence of an immediate closing of the return valve 16 as a result of the spring loading on the valve piston 17. The outflow of the hydraulic medium is accordingly interrupted.

Subjected to pressure by the hydraulic medium, the control piston 26 is urged into the position stop-limited by the screw 41, according to the representation in FIG. 3, after which the forward displacement of the moving part 7, and accordingly the pressing operation, is carried out.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application.

The invention claimed is:

1. A method of operating a hydraulic pressing unit comprising:

providing a pressing unit having a hydraulic pump, a moving part, a stationary part and a return valve;

filling a hydraulic chamber in said pressing unit with hydraulic medium from a supply chamber, said hydraulic chamber being capable of being in fluid communication with said return valve along a flow path;

displacing the moving part into a pressing position by the buildup of a hydraulic pressure within said hydraulic chamber;

automatically moving said moving part from the pressing position into an end position under the action of a restoring spring;

wherein when said return valve is in an open position in which hydraulic medium is allowed to flow through said return valve, said return valve moves to a closed position in which the flow of hydraulic medium is prevented through said return valve after the hydraulic pressure acting on the return valve drops below a certain pressure as a result of the hydraulic medium flowing away from said return valve;

and wherein means are provided in the flow path between said return valve and said moving part for causing the hydraulic medium to flow away from said return valve.

2. The method as claimed in claim 1, wherein said means is a control piston.

3. The method as claimed in claim 2, wherein in a non-actuated outflow position, the control piston allows hydraulic medium to flow along said flow path from said hydraulic chamber to said relief valve and, in an actuated pumping position, the control piston prevents the flow of hydraulic medium along said flow path.

4. The method as claimed in claim 3, wherein said control piston is moved out of said outflow position into the pumping position by pumping hydraulic medium out of the supply chamber into the hydraulic chamber.

5. The method as claimed in claim 1, wherein said return valve is moved to the closed position prior to said moving part reaching the end position.

6. A hydraulic pressing unit comprising:

a housing;

a hydraulic pump provided within said housing;

a supply chamber provided within said housing and capable of having a hydraulic medium therein;

a hydraulic chamber provided within said housing and capable of having the hydraulic medium therein;

a moving part provided within said housing in fluid communication with the hydraulic chamber;

a restoring spring provided within said housing, said restoring spring capable of acting upon said moving part to cause said moving part to move within said housing;

a stationary part attached to said housing;

a return valve provided within said housing and in fluid communication with the hydraulic medium, said return valve capable of being moved to an open position and a closed position, said return valve capable of being in fluid communication with said hydraulic chamber along a flow path;

the moving part being displaced from a starting position into a pressing position as a result of filling said hydraulic chamber with the hydraulic medium from said supply chamber by using the hydraulic pump, the return valve being automatically displaced into an open position in which hydraulic medium is allowed to flow through said return valve as a result of a hydraulic pressure corresponding to the pressing position, and the moving part returning under the action of said restoring spring, and means are provided in the flow path between said return valve and said moving part for causing the hydraulic medium to flow away from said return valve, thereby lowering the hydraulic pressure acting on said relief valve to below a certain pressure, such that the return valve is displaced into the closed position, wherein in said closed position hydraulic medium is prevented from flowing through said return valve.

7. The pressing unit as claimed in claim 6 wherein the hydraulic chamber has a first sub-chamber, in which the moving part is displaced, and a second sub-chamber, which is formed as a line portion in which the hydraulic medium for filling or emptying the first sub-chamber flows, said means are disposed in the second sub-chamber.

8. The pressing unit as claimed in claim 7, wherein the means comprise a control piston positioned in the second sub-chamber, said control piston being moveable within the second sub-chamber.

9. The pressing unit as claimed in claim 8, further including a hydraulic line which is in fluid communication with the hydraulic pump, wherein said control piston includes a piston shaft, the piston shaft is capable of opening or closing said hydraulic line.

10. The pressing unit as claimed in claim 9, further including an outflow line which is in fluid communication with the return valve, wherein said control piston includes a piston head, the piston head is formed for opening or closing said outflow line.

11. The pressing unit as claimed in claim 8, wherein the control piston includes first, second and third areas of action which are separate from one another.

12. The pressing unit as claimed in claim 11, wherein said first area of action is associated with the first sub-chamber.

13. The pressing unit as claimed in claim 11, further including an outflow line which is in fluid communication with the return valve, wherein said control piston includes a piston head, the piston head is formed for opening or closing said outflow line, and wherein said second area of action is disposed opposite to the first area of action, and is associated with the outflow line.

14. The pressing unit as claimed in claim 11, wherein said third area of action is disposed opposite the first area of action, said third area of action is associated with the hydraulic pump.

15. The pressing unit as claimed in claim 11, wherein said second and third areas of action together correspond in terms of size to the first area of action.

16. The pressing unit as claimed in claim 10, wherein said piston includes a piston head, and the piston head is capable of being accommodated in an annular space of enlarged diameter in comparison with the piston head, which annular space is in fluid communication with the outflow line.

17. The pressing unit as claimed in claim 16, wherein the control piston acts as a slide valve to close the hydraulic line.

18. The pressing unit as claimed in claim 16, wherein the control piston acts as a slide valve to close the outflow line.

19. The pressing unit as claimed in claim 8, wherein said control piston includes an integrated pressure relief valve.

20. The pressing unit as claimed in claim 19, wherein said pressure relief valve is formed by a cup-spring-like valve disk secured by a pin.

21. The pressing unit as claimed in claim 20, wherein said pin is a screw.

22. The pressing unit as claimed in claim 10, wherein said control piston, part of the outflow line and part of the hydraulic line are formed in an insert part mounted in a bore-like continuation of the first sub-chamber.

* * * * *

UNITED STATES PATENT AND TRADEMARK OFFICE

CERTIFICATE OF CORRECTION

PATENT NO. : 7,908,963 B2
APPLICATION NO. : 12/302549
DATED : March 22, 2011
INVENTOR(S) : Egbert Frenken It is certified that error appears in the above-identified patent and that said Letters Patent is hereby corrected as shown below:

IN THE SPECIFICATIONS:

Column 8, Line 37, delete "When the valve piston 17 is seated, the bore 20 is open."

IN THE CLAIMS:

Column 12, Claim 1, Line 49, – after "return valve" insert -- , said return valve capable of being in an open position in which hydraulic medium is allowed to flow through said return valve and in a closed position in which the flow of hydraulic medium is prevented through said return valve --

Column 12, Claim 1, Lines 60-67 – delete "wherein when said the return valve is in an open position in which hydraulic medium is allowed to flow through said return valve, said return valve moves to a closed position in which the flow of hydraulic medium is prevented through said return valve after the hydraulic pressure acting on the return valve drops below a certain pressure as a result of the hydraulic medium flowing away from said return valve;"

Column 13, Claim 1, Line 1 – delete "wherein" after "and" and replace it with -- using --

Column 13, Claim 1, Line 1, – delete "are" after "means"

Column 13, Claim 1, Lines 2-3 – delete "causing the hydraulic medium to flow away from"

Column 13, Claim 1, Line 2 – after "part for" insert -- lowering the hydraulic pressure of the hydraulic medium to move said return valve into said closed position prior to said moving part reaching said end position. --

Column 13, Claim 5, Lines 16-18 – delete claim 5.

Signed and Sealed this
Twenty-fourth Day of April, 2012

David J. Kappos

David J. Kappos
*Director of the United States Patent and Trademark Office*

Column 13, Claim 6, Line 27 – after "chamber;" insert -- said moving part capable of being in a pressing position and in an end position; --

Column 13, Claim 6, Line 31 – after "housing" insert -- from said pressing position to said end position --

Column 13, Claim 6, Line 34 – after "open position" insert -- in which hydraulic medium is allowed to flow through said return valve --

Column 13, Claim 6, Line 34 – after "and" please insert -- to --

Column 13, Claim 6, Line 35 – after "closed position" please insert -- in which the flow of hydraulic medium is prevented through said return valve --

Column 13, Claim 6, Line 38 – after "displaced from" delete "a starting" and replace it with -- said end --

Column 13, Claim 6, Line 39 – after "into" please delete "a" and replace it with -- said --

Column 13, Claim 6, Line 42 – after "into" please delete "an" and replace it with -- said --

Column 13, Claim 6, Lines 42-44 – delete "in which hydraulic medium is allowed to flow through said return valve"

Column 13, Claim 6, Line 46 – after "returning" insert -- to said end position --

Column 13, Claim 6, Line 47 – after "means" delete "are"

Column 13, Claim 6, Lines 48-49 – after "part for" delete "causing the hydraulic medium to flow away from said return valve, thereby"

Column 13, Claim 6, Line 52 – after "closed position" insert -- prior to said moving part reaching said end position --

Column 13, Claim 6, Lines 52-54 – delete "wherein in said closed position hydraulic medium is prevented from flowing through said return valve"

Please add claims 22-26

22. The method as claimed in claim 1, further including briefly decoupling a partial amount of the hydraulic medium.

23. The method as claimed in claim 3, wherein in a return direction of the moving part, the control piston is disposed beyond said end position of the moving part.

24. The pressing unit as claimed in claim 7, wherein said means further decouple a partial amount of the hydraulic medium.

25. The pressing unit as claimed in claim 7, wherein the means are formed in the line portion for switching over between a first line path and a second line path, the decoupling during the switching over.

26. The pressing unit as claimed in claim 12, wherein said control piston is movable between an outflow position and a pumping position.

UNITED STATES PATENT AND TRADEMARK OFFICE

CERTIFICATE OF CORRECTION

PATENT NO. : 7,908,963 B2
APPLICATION NO. : 12/302549
DATED : March 22, 2011
INVENTOR(S) : Egbert Frenken It is certified that error appears in the above-identified patent and that said Letters Patent is hereby corrected as shown below:

Delete the title page and substitute therefore the attached title page showing the corrected number of claims in patent.

IN THE SPECIFICATIONS:

Column 8, Line 37, delete "When the valve piston 17 is seated, the bore 20 is open."

IN THE CLAIMS:

Column 12, Claim 1, Line 49, – after "return valve" insert -- , said return valve capable of being in an open position in which hydraulic medium is allowed to flow through said return valve and in a closed position in which the flow of hydraulic medium is prevented through said return valve --

Column 12, Claim 1, Lines 60-67 – delete "wherein when said the return valve is in an open position in which hydraulic medium is allowed to flow through said return valve, said return valve moves to a closed position in which the flow of hydraulic medium is prevented through said return valve after the hydraulic pressure acting on the return valve drops below a certain pressure as a result of the hydraulic medium flowing away from said return valve;"

Column 13, Claim 1, Line 1 – delete "wherein" after "and" and replace it with -- using --

Column 13, Claim 1, Line 1, – delete "are" after "means"

Column 13, Claim 1, Lines 2-3 – delete "causing the hydraulic medium to flow away from"

This certificate supersedes the Certificate of Correction issued April 24, 2012.

Signed and Sealed this
Fifteenth Day of May, 2012

David J. Kappos

David J. Kappos
*Director of the United States Patent and Trademark Office*

Column 13, Claim 1, Line 2 – after "part for" insert -- lowering the hydraulic pressure of the hydraulic medium to move said return valve into said closed position prior to said moving part reaching said end position. --

Column 13, Claim 5, Lines 16-18 – delete claim 5.

Column 13, Claim 6, Line 27 – after "chamber;" insert -- said moving part capable of being in a pressing position and in an end position; --

Column 13, Claim 6, Line 31 – after "housing" insert -- from said pressing position to said end position --

Column 13, Claim 6, Line 34 – after "open position" insert -- in which hydraulic medium is allowed to flow through said return valve --

Column 13, Claim 6, Line 34 – after "and" please insert -- to --

Column 13, Claim 6, Line 35 – after "closed position" please insert -- in which the flow of hydraulic medium is prevented through said return valve --

Column 13, Claim 6, Line 38 – after "displaced from" delete "a starting" and replace it with -- said end --

Column 13, Claim 6, Line 39 – after "into" please delete "a" and replace it with -- said --

Column 13, Claim 6, Line 42 – after "into" please delete "an" and replace it with -- said --

Column 13, Claim 6, Lines 42-44 – delete "in which hydraulic medium is allowed to flow through said return valve"

Column 13, Claim 6, Line 46 – after "returning" insert -- to said end position --

Column 13, Claim 6, Line 47 – after "means" delete "are"

Column 13, Claim 6, Lines 48-49 – after "part for" delete "causing the hydraulic medium to flow away from said return valve, thereby"

Column 13, Claim 6, Line 52 – after "closed position" insert -- prior to said moving part reaching said end position --

Column 13, Claim 6, Lines 52-54 – delete "wherein in said closed position hydraulic medium is prevented from flowing through said return valve"

Please add claims 22-26

22. The method as claimed in claim 1, further including briefly decoupling a partial amount of the hydraulic medium.

23. The method as claimed in claim 3, wherein in a return direction of the moving part, the control piston is disposed beyond said end position of the moving part.

24. The pressing unit as claimed in claim 7, wherein said means further decouple a partial amount of the hydraulic medium.

25. The pressing unit as claimed in claim 7, wherein the means are formed in the line portion for switching over between a first line path and a second line path, the decoupling during the switching over.

26. The pressing unit as claimed in claim 12, wherein said control piston is movable between an outflow position and a pumping position.

(12) United States Patent
Frenken

(10) Patent No.: US 7,908,963 B2
(45) Date of Patent: Mar. 22, 2011

(54) METHOD OF OPERATING A HYDRAULIC PRESSING UNIT, AND HYDRAULIC PRESSING UNIT HAVING A HYDRAULIC PUMP

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 12/302,549

(22) PCT Filed: May 29, 2007

(86) PCT No.: PCT/EP2007/055156

§ 371 (c)(1),
(2), (4) Date: Jan. 5, 2009

(87) PCT Pub. No.: WO2007/141156

PCT Pub. Date: Dec. 13, 2007

(65) Prior Publication Data

US 2009/0133591 A1 May 28, 2009

(30) Foreign Application Priority Data

Jun. 8, 2006 (DE) ..... 10 2006 026 552

(51) Int. Cl.
*B30B 1/23* (2006.01)

(52) U.S. Cl. ..... 100/269.01; 72/453.01

(58) Field of Classification Search ..... 100/269.01, 100/279, 269.14, 269.15, 269.16, 269.18, 100/269.19; 72/453.01, 453.14, 453.15, 453.16, 453.17, 453.18, 453.19

See application file for complete search history.

(56) References Cited

U.S. PATENT DOCUMENTS

| | | | | |
|---|---|---|---|---|
| 3,884,262 | A * | 5/1975 | Assembergs | 137/489 |
| 3,973,595 | A * | 8/1976 | Schmoll | 137/637.1 |
| 4,433,612 | A * | 2/1984 | Spielvogel et al. | 91/514 |
| 5,315,744 | A * | 5/1994 | Denham et al. | 29/243.53 |
| 5,778,516 | A * | 7/1998 | Dear et al. | 29/707 |
| 6,718,870 | B1 | 4/2004 | Frenken | |
| 6,769,356 | B2 | 8/2004 | Frenken | |
| 7,331,205 | B2 * | 2/2008 | Chitty et al. | 72/21.1 |

FOREIGN PATENT DOCUMENTS

| | | |
|---|---|---|
| DE | 198 25 160 | 4/1999 |
| DE | 198 14 202 | 10/1999 |

* cited by examiner

*Primary Examiner* — Jimmy T Nguyen
(74) *Attorney, Agent, or Firm* — Clark Hill PLC

(57) ABSTRACT

A hydraulic pressing unit includes a hydraulic pump, supply and hydraulic chambers, moving and stationary parts, a restoring spring, and a return valve provided within or attached to a housing. The moving part is displaced from a starting position into a pressing position as a result of filling the hydraulic chamber with a hydraulic medium from the supply chamber by using the hydraulic pump. The return valve is automatically displaced into an open position as a result of a hydraulic pressure corresponding to the pressing position, and the restoring spring moves the moving part. A piston acts on the flow of the hydraulic medium and lowers the pressure such that the return valve is displaced into the closed position.

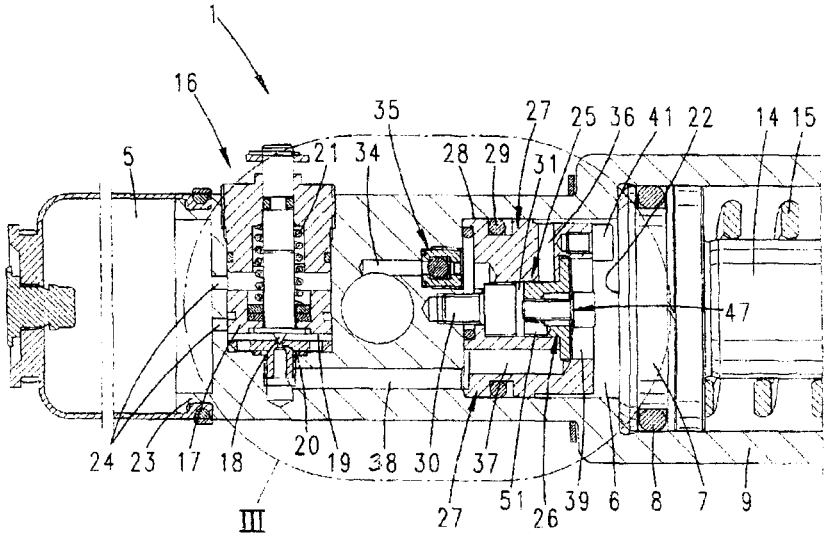

26 Claims, 6 Drawing Sheets